US005979424A

United States Patent [19]

Alvarez et al.

[11] Patent Number: 5,979,424

[45] Date of Patent: Nov. 9, 1999

[54] TOY GUN FOR FIRING BALLOONS

[76] Inventors: Jorge Alvarez; Mary Alvarez, both of 3030 E. First St., Los Angeles, Calif. 90063

[21] Appl. No.: 09/103,139

[22] Filed: Jun. 22, 1998

[51] Int. Cl.[6] ..... F41B 7/08

[52] U.S. Cl. ..... 124/16; 124/26

[58] Field of Search ..... 124/16, 17, 20.1, 124/21, 26, 27

[56] References Cited

U.S. PATENT DOCUMENTS

| | | | |
|---|---|---|---|
| 899,448 | 9/1908 | Grobl | 124/27 |
| 970,018 | 9/1910 | Coleman | 124/27 |
| 2,600,883 | 6/1952 | King | 124/16 X |
| 2,633,119 | 3/1953 | Blauderer et al. | 124/27 |
| 2,944,822 | 7/1960 | Brown | 124/27 X |
| 2,962,837 | 12/1960 | Lemelson | 124/27 X |
| 3,166,321 | 1/1965 | Fleishman | 124/27 |
| 4,086,901 | 5/1978 | Clement | 124/21 |
| 4,922,884 | 5/1990 | Ford | 124/20.1 |

*Primary Examiner*—John A. Ricci
*Attorney, Agent, or Firm*—Erik M. Arnem

[57] ABSTRACT

A toy gun can be equipped with a specially configured ram for firing air-filled or water-filled balloons. The forward surface of the ram has a hemi-spheric contour, so that the ram has extensive surface area engagement with the balloon rear surface. When the ram is fired forwardly the balloon is subjected to relatively low unit area acceleration forces, so that the balloon has a lessened likelihood of rupture or excessive deformation.

4 Claims, 1 Drawing Sheet

TOY GUN FOR FIRING BALLOONS

SUMMARY OF THE INVENTION

Our invention relates to a toy gun for firing (or propelling) spherical balloons out of the gun. The balloons can be air-filled or water-filled. The gun can be used to fire the balloons toward a target or toward other persons at a velocity that will be relatively harmless to any person struck by the balloon. Typically, each spherical balloon will have a diameter measuring about two inches.

Various toy guns have been devised for firing ping-pong balls and other spherical projectiles out of the gun. As far as I am award, no toy guns have been devised for firing air-filled or water-filled balloons.

U.S. Pat. No. 2,574,408 discloses a toy gun employing compressed air for firing baseballs out of the gun barrel.

U.S. Pat. No. 2,636,738 shows a toy gun having a spring-biased plunger adapted to forcibly contact a ping pong ball in a funnel-shaped gun barrel, whereby the ping-pong ball is fired out of the gun.

U.S. Pat. No. 472,608 discloses a toy gun having a spring-operated ram for firing a spherical marble out of the gun barrel. The marble is loaded into the gun barrel through a top loading port proximate to the leading face of the ram. A trigger-operated latch for the ram has a projection that prevents the marble from inadvertantly rolling out of the barrel.

U.S. Pat. No. 4,227,508 shows a toy gun having a loading chute for loading ping pong balls into the gun barrel; an obstruction 76 on the gun barrel prevents the balls from rolling out of the barrel. The ping pong ball is fired out of the barrel by a spring-operated ram 50 slidably mounted for movement in a plane extending through the ball axis.

The toy guns disclosed in the above-noted patents have ram surfaces that have very limited contact areas with the spherical object being propelled out of the gun. Typically, the ram has point contact or line contact with the spherical projectile. Such contact is suitable when the spherical object has a rigid, non-deformable, spherical surface, e.g. as in the case of a ping pong ball, marble, or baseball. However, it is not believed that a ram having limited contact with a spherical balloon would be suitable. It is believed that the limited contact area would result in puncturing of the balloon, or insufficient balloon movement out of the barrel.

An air-filled or water-filled spherical balloon has a relatively soft deformable surface. A ram having point contact or line contact with the balloon will tend to either puncture the balloon or form a localized depression in the balloon surface. When the ram forms a localized depression in the balloon surface, the depression will tend to progressively enlarge to a point where there is a rupture at the highest stress point in the balloon surface. Also, the ram energy will be dissipated as balloon deformation, rather than forward motion of the balloon. The result will tend to be reduced balloon travel.

The present invention relates to a toy gun specifically designed to fire spherical balloons, either air-filled or water-filled; i.e. the same gun can be used to fire either an air-filled balloon or a water-filled balloon. A major feature of the invention is that the spring-biased ram has a hemi-spheric surface engageable with the balloon. The spherical ram surface has large area contact with the spherical balloon surface, so that the balloon is stressed substantially uniformly over a relatively large surface area. The balloon thus has a lessened tendency to rupture, since unit area forces on the balloon surface are relatively low.

Another advantage of the hemi-spheric ram surface is that the balloon will experience a lessened total deformation, with a resultant greater travel distance (range) out of the gun. The lessened total deformation results from the fact that the unit area forces on the balloon surface are relatively low. The ram forces are distributed over a relatively large balloon surface area so that the balloon has a relatively greater resistance against deformation or rupture.

As a further feature of the invention, the ram is held in its retracted position by a trigger-operated latch having a spherical surface forming a smooth continuation of the hemi-spheric ram surface (when the ram is in its retracted position). The spherical surface on the latch acts as a retainer for the spherical balloon, so that the balloon is prevented from rolling out of the gun barrel, e.g. should the barrel be pointed downwardly prior to firing the balloon out of the gun.

The spherical latch surface conforms to the balloon surface so that the balloon is urged by the latch into good contact with the hemi-spheric ram surface. When the ram is fired the ram force is immediately transferred to the balloon, such that there is no time lag between ram acceleration and balloon impact that could produce high momentary impact forces on the balloon surface. The ram and balloon accelerate together, without generating impact forces between the ram and balloon.

Further features of the invention will be apparent from the attached drawings and description of an illustrative embodiment of the invention.

THE DRAWINGS

FIG. 1 is taken on line 1—1 in FIG. 2.

DESCRIPTION OF A PREFERRED EMBODIMENT OF THE INVENTION

Figure 1:
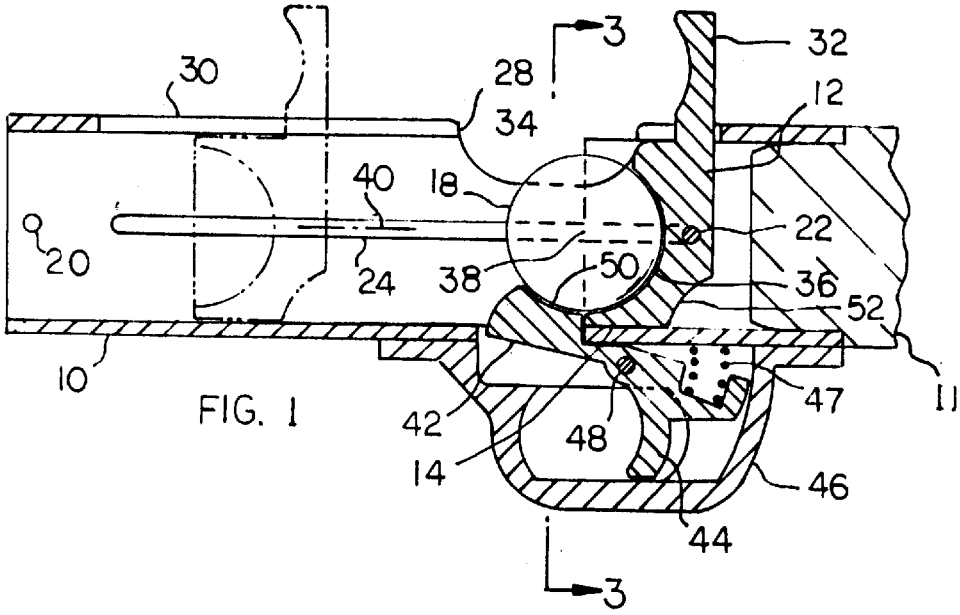
FIG. 1 is a fragmentary longitudinal sectional view taken through a toy gun forming an illustrative embodiment of the invention.

Referring to the drawings, there is shown a toy gun that comprises a tubular cylindrical gun barrel 10 attached to a shoulder stock 11, as by a press fit and gluing. The gun barrel and stock can be formed of plastic or metal.

Slidably positioned in barrel 10 is a ram 12 having a cylindrical edge surface 14 that has a sliding clearance on the cylindrical inner surface of the barrel. Ram 12 has a retracted position, as shown in full lines (FIG. 1) and a forward (fired) position, as shown in dashed lines. Two tension springs 16 are provided along opposite side surfaces of barrel 10 for rapidly moving ram 12 from its retracted position to its forward position, so as to fire a spherical balloon 18 out of the barrel 10 in a right-to-left direction.

Figure 3:
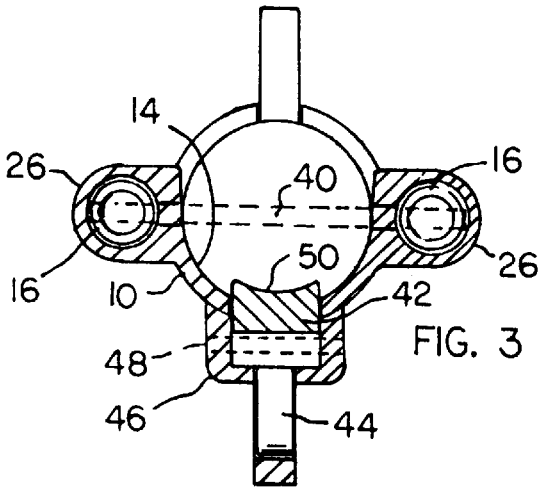
FIG. 3 is a transverse sectional view taken on line 3—3 in FIG. 1.

The forward ends of tension springs 16 are connected to gun barrel 10 by transverse pins 20. The rear ends of tension springs 16 are attached to ram 12 by a single transverse connector pin 22 that extends through the ram and both tension springs. Slots 24 (FIG. 1) in the side wall of barrel 10 permit connector pin 22 to move with ram 12 as the ram moves between its two limiting positions. As shown in FIG. 3, the tension springs 16 can be housed in auxiliary tubular housings 26 carried by barrel 10, whereby the child, or user, is protected against having his fingers pinched by the springs.

Balloon 18 can be an air-filled balloon or a water-filled balloon having a spherical configuration. The diameter of the spherical balloon is typically about two inches. The balloon can be loaded into gun barrel 10 through a top access loading port 28 formed in the barrel upper surface. Port 28 is preferably circular, as viewed in FIG. 2. The diameter of the circular loading port is preferably slightly greater than the balloon diameter.

The upper surface of barrel 10 has a longitudinal slot 30 sized to accommodate a handle 32 that extends upwardly from ram 12. Handle 32 is used for manually pulling ram 12 from its forward position (dashed lines) to its retracted position against the opposition of tension springs 16. The balloon loading port 28 intersects, or interrupts, the longitudinal slot 30, but without any adverse effect on the handle motion. Transverse spring connector pin 22 is slidably guided by slots 24, to maintain the ram in an upright position, with handle 32 extending upwardly through slot 30.

The leading edge 34 of ram 12 has a hemi-spheric cavity 36 centered on a point 38 located on the longitudinal centerline 40 of cylindrical barrel 10, whereby the cavity 36 surface has extensive surface area engagement with the surface of balloon 18. Cavity surface 36 is symmetrical with barrel longitudinal centerline 40, such that one half of the cavity surface is above centerline 40 and one half of the cavity surface is below centerline 40. With such an arrangement, the ram forces exerted on the balloon are coincident with the ram movement direction, so that ram force is efficiently used for balloon propulsion purposes.

A trigger-operated latch 42 is located to releasably hold ram 12 in its retracted position. As shown, latch 42 is integral with a finger-operated trigger 44 located in a trigger housing 46 that is secured to the undersurface of barrel 10. The integral latch-trigger unit is mounted for swinging motion on a transverse pivot pin 48 carried by housing 46. The trigger is urged upwardly by a light spring 47 through a clearance opening in barrel 10 to engage the leading edge 34 of ram 12, thereby retaining the ram against forward motion from its retracted position. When trigger 44 is pulled the latch swings down out of engagement with ram 12, whereby the ram moves forwardly under the impetus of spring means 16 (i.e. the two tension springs).

Latch 42 has a spherical upper surface 50 that forms a smooth continuation of the hemi-spheric cavity surface 36 when ram 12 is in its retracted position. When the spherical balloon is placed in loading port 28 it comes into contact with latch surface 50; the latch surface guides the balloon rearwardly into engagement with ram spherical cavity surface 36 so that the balloon is effectively retained between the ram and latch. Should the barrel of the toy gun be pointed downwardly prior to firing the balloon the balloon will not drop out of the barrel. Latch 42 retains the balloon in position against cavity surface 36. The latch also retains the ram in a fixed retracted position, as depicted in FIG. 1.

When trigger 44 is pulled, the latch 42 is disengaged from the leading edge 34 of the ram; at the same time the latch moves downwardly through the clearance opening in barrel 10, such that ram 12 is enabled to fire forwardly to the forward position, under the impetus of tension springs 16. The balloon is thus fired out through the gun barrel in a right-to-left direction.

Figure 2:
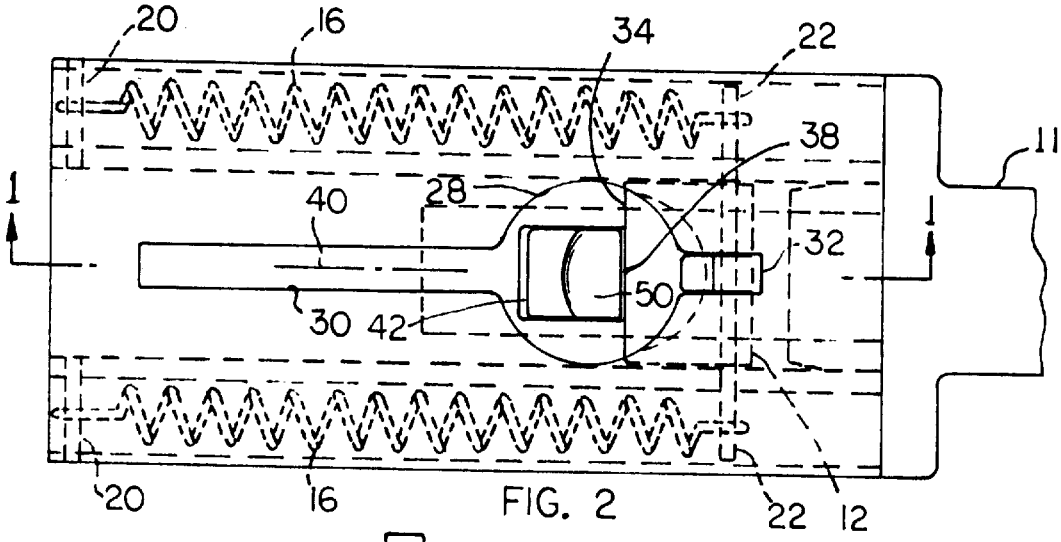
FIG. 2 is a top plan view of the FIG. 1 toy gun.

To facilitate an understanding of the structure, the balloon is omitted from FIGS. 2 and 3; the balloon is shown in FIG. 1. An advantage of the illustrated arrangement is that hemi-spheric cavity surface 36 has extensive area engagement with the balloon surface. Essentially the entire rear surface of the balloon is in contact with the balloon at the moment of firing. Also, at the instant of firing, the balloon rear surface is in contact with cavity surface 36 by the action of latch 42; latch surface 50 holds the balloon against cavity surface 36 until the moment of firing. There is essentially no lost motion between ram movement and balloon movement; the ram and balloon accelerate together, without generating undesired impact stresses in the balloon skin material.

The extensive surface area engagement between the ram and balloon results in low unit area forces on the balloon, with resultantly low deformation of the balloon surface. The ram kinetic energy is efficiently translated into forward balloon motion.

To reset the gun to a position for firing another balloon, handle 32 is pulled to return ram to its retracted position. During this ram return motion the ram surface 52 can cam the latch downwardly out of the ram path. As the ram reaches its retracted position, spring 47 moves the latch-trigger unit to the FIG. 1 latching position. A new balloon is loaded into the toy gun when ram 12 is in its retracted position.

The drawings illustrate a preferred embodiment of the invention. However, it will be appreciated that the invention can be noticed in various forms and configurations. For example, various spring constructions and latch-trigger arrangements can be used.

We claim:

1. A toy gun for propelling a fluid-filled balloon out of the gun, comprising:

a tubular barrel having a longitudinal axis;

a ram having a leading edge slidably positioned in said barrel for movement between a retracted position and a forward position;

spring means for firing said ram from the retracted position to the forward position;

a latch projectible into said barrel for holding the ram in the retracted position; and a trigger for moving said latch from a first position engaged with the ram to a second position disengaged from the ram, whereby said spring means is enabled to fire the ram from the retracted position to the forward position;

said ram having a concave spherical balloon-seating surface centered at a point on the barrel longitudinal axis for engaging the spherical surface of a balloon placed in said barrel, whereby the ram exerts essentially uniform force on approximately one half of the total balloon surface, when the ram is fired; said latch engaging said ram at the ram leading edge when said ram is in the retracted position; said latch having a spherical balloon-retention surface forming a continuation of the spherical seating surface on the ram when the latch is in position to hold the ram in the retracted position.

2. The toy gun of claim 1, wherein said latch and trigger are integrated together as a one piece unit.

3. A toy gun for propelling a fluid-filled balloon out of the gun, comprising:

a tubular barrel having a longitudinal axis;

a ram slidably positioned in said barrel for movement between a retracted position and a forward position;

spring means for firing said ram from the retracted position to the forward position;

a latch projectible into said barrel for holding the ram in the retracted position; and a trigger for moving said latch from a first position engaged with the ram to a second position disengaged from the ram, whereby said spring means is enabled to fire the ram from the retracted position to the forward position;

said ram having a concave spherical balloon-seating surface centered at a point on the barrel longitudinal axis for engaging the spherical surface of a balloon placed in said barrel; said spherical seating surface being symmetrical relative to the barrel longitudinal axis, whereby the ram exerts essentially uniform force on approximately one half of the total balloon surface, when the ram is fired;

said spring means comprising two separate tension springs extending parallel to the barrel equidistant from the barrel longitudinal axis, and a spring connector pin extending through said ram and both tension springs on a line transverse to the barrel longitudinal axis.

4. A toy gun for propelling a fluid-filled balloon out of the gun, comprising:

a tubular barrel having a longitudinal axis;

a ram slidably positioned in said barrel for movement between a retracted position and a forward position;

spring means for firing said ram from the retracted position to the forward position;

a latch projectible into said barrel for holding the ram in the retracted position; and a trigger for moving said latch from a first position engaged with the ram to a second position disengaged from the ram, whereby said spring means is enabled to fire the ram from the retracted position to the forward position;

said ram having a concave spherical balloon-seating surface centered at a point on the barrel longitudinal axis for engaging the spherical surface of a balloon placed in said barrel, whereby the ram exerts essentially uniform force on approximately one half of the total balloon surface, when the ram is fired;

said concave spherical seating surface being a hemi-spheric surface symmetrical relative to the barrel longitudinal axis; said latch having a spherical balloon-retention surface forming a continuation of said hemi-spheric surface when the ram is in its retracted position;

said barrel having a balloon-loading port located slightly forward from said hemi-spheric surface in registry with said latch so that when a balloon is placed in said port the spherical latch surface guides the balloon into engagement with the hemi-spheric surface on the ram.

* * * * *